United States Patent [19]

Hearst

[11] Patent Number: 4,590,100

[45] Date of Patent: May 20, 1986

[54] PASSIVATION OF STEEL WITH AQUEOUS AMINE SOLUTIONS PREPARATORY TO APPLICATION OF NON-AQUEOUS PROTECTIVE COATINGS

[75] Inventor: Peter J. Hearst, Oxnard, Calif.

[73] Assignee: The United States of America as represented by the Secretary of the Navy, Washington, D.C.

[21] Appl. No.: 729,849

[22] Filed: May 3, 1985

Related U.S. Application Data

[63] Continuation-in-part of Ser. No. 546,252, Oct. 28, 1983, abandoned.

[51] Int. Cl.[4] ..... B05D 3/10; B08B 30/00

[52] U.S. Cl. ..... 427/327; 427/388.5; 134/27; 134/28; 134/29; 148/6.14 R

[58] Field of Search ..... 134/27, 28, 29; 427/327, 388.5; 148/6.14 R; 252/390, 401

[56] References Cited

U.S. PATENT DOCUMENTS

| | | | |
|---|---|---|---|
| 3,072,502 | 1/1963 | Alfand | 134/27 X |
| 3,154,438 | 10/1964 | Keller et al. | 148/6.15 R |
| 3,368,913 | 2/1968 | Ziehr et al. | 148/6.15 R X |
| 3,519,458 | 7/1970 | Rausch | 427/327 X |
| 4,045,253 | 8/1977 | Banks et al. | 134/27 X |

*Primary Examiner*—Benoit Castel

*Attorney, Agent, or Firm*—Robert F. Beers; Joseph M. St. Amand

[57] ABSTRACT

This is a process that allows previously cleaned steel (which may have been cleaned in any of several different ways) to be passivated with a rinse of almost pure water, that is made slightly alkaline to inhibit corrosion, and flash rusting such that any small residue remaining on the steel surface after drying of the water will itself evaporate and in such a manner that any remaining residue will be incorporated into a subsequently applied non-aqueous protective coating without leaving any water-soluble or ionic residue on the surface of the steel that will cause corrosion or affect adhesion of the protective coating.

30 Claims, No Drawings

PASSIVATION OF STEEL WITH AQUEOUS AMINE SOLUTIONS PREPARATORY TO APPLICATION OF NON-AQUEOUS PROTECTIVE COATINGS

This invention is a continuation-in part of abandoned U.S. patent application Ser. No. 546,252, filed Oct. 28, 1983, by Peter J. Hearst. This invention also relates to U.S. patent application Ser. No. 546,253, filed Oct. 28, 1983, by Warren E. Zell et al, for VACUUM RECYCLABLE SYSTEM FOR CHEMICAL-THERMO CLEANING OF SHIP TANKS AND BILGES, and is commonly assigned, now U.S. Pat. No. 4,530,131.

BACKGROUND OF THE INVENTION

This invention relates to a method for passivation of cleaned steel surfaces, and particularly to an effective method for preventing of flash rusting of cleaned wet steel that is drying prior to the application of a non-aqueous protective coating.

It is well known that steel surfaces need to be dry before the application of solvent-based coatings, such as epoxy and urethane high performance coatings for example, because such coatings will not adhere well to moist surfaces and water on the surfaces will not readily dissolve in or be displaced by the applied solvent-based formulated coatings. The drying of cleaned steel after rinsing with water readily produces flash rusting, especially when the humidity is high or the temperature is elevated.

It is also well known that water-soluble residues, and especially ionic water-soluble residues, remaining on a steel surface after application of a protective coating, will decrease coating performance and increase corrosion. Therefore, the cleaned steel surfaces should be free of such residues when the protective coating is applied.

Furthermore, it is well known that rusting is inhibited in an alkaline environment. Thus, water-soluble amines are sometimes added to latex or water-dispersed coatings for steel to reduce corrosion. Water-soluble amines also have been added to final rinses for cleaned steel, but always in combination with other materials (such as other alkaline chemicals, citric acid, sodium nitrite, etc., and as exemplified in U.S. Pat. Nos. 3,072,502; 3,154,438; 3,368,913; 3,519,458; and 4,045,253) and therefore these rinses have left insoluble residues on the steel surfaces that are detrimental to optimum performance of subsequently applied protective coatings.

In the prior art, cleaned steel is often passivated by treating with an alkaline sodium nitrite solution to provide altered surface characteristics that resist rusting; for unknown reasons, this method sometimes does not work. Dilute solutions of citric acid made alkaline with ammonia or with an amine have been used for passivation of cleaned steel surfaces. These same solutions also have been used in combination with sodium nitrite. A disadvantage of all these methods is that when the residual passivation solution evaporates, water-soluble materials remain behind which can affect the adhesion and the water resistance of subsequently applied non-aqueous protective coatings. Mixing sodium nitrite passivation solution with an acid solution, such as that remaining on steel surfaces following a cleaning process, will result in formation of hazardous, volatile toxic oxides of nitrogen; this also is avoided by the present invention.

SUMMARY OF THE INVENTION

This invention is a process that allows previously cleaned steel (which may have been cleaned in any of several different ways) to be passivated with a rinse of almost pure water, that is made slightly alkaline with an amine to inhibit corrosion preparatory to application of non-aqueous protective coatings, such that any small amine residue remaining on the steel surface after drying of the water will itself evaporate and in such a manner that any remaining amine residue will be incorporated into the non-aqueous protective coating without leaving any water-soluble or ionic residue on the surface of the steel.

The method of the present invention passivates steel and/or prevents flash rusting of cleaned steel surfaces by ensuring that all water in contact with the steel surface remains in an alkaline condition; also, this method leaves essentially no undesirable residue on the steel after the passivation solution has evaporated. After the water is completely evaporated, there is no flash rusting, because the presence of liquid water is necessary to produce flash rusting. The steel may be cleaned with a chemical cleaning solution, for example, of 5 to 10 percent citric acid solution adjusted to a pH of about 3.5 using ammonia or triethanolamine to clean and derust the surfaces down to bare metal. The citric acid solution is applied at approximately 160 degrees F., for example. Other methods, such as wet sand blasting, can also be used for stripping old paint, scale, rust, etc., to provide cleaned metal surfaces. The cleaned metal surfaces then are washed down with a solution, such as 3 percent triethanolamine solution, to neutralize and wash out any remaining citric acid solution or any residues from other cleaning methods, and a passivating solution of 1 percent triethanolamine is then applied to the metal surface and dried to leave the surface slightly alkaline until all water and any moist amine remaining on the metal surfaces are evaporated. The surfaces are then ready to be preserved with a protective coating. The wash and passivation solutions can be applied hot to speed up cleaning and/or drying, if desired. The minimal amount of amine, if any, that may remain on the cleaned steel surface after drying will react with or will be incorporated into the subsequently applied solvent-based protective coating and will not affect adhesion or performance. Solvent-based coatings, as used here, includes "100% solids coatings" in which reactive solvents or diluents are used.

DESCRIPTION OF THE PREFERRED EMBODIMENTS

The present method for the passivation of steel surfaces preparatory to the application of non-aqueous protective coatings results in a metal surface essentially free of residue and slightly alkaline. A preferred chemical cleaning solution for use in cleaning steel surfaces is a 5 to 10 percent citric acid solution adjusted to a pH of about 3.5 using ammonia or triethanolamine to clean and derust the surfaces down to bare metal. The citric acid solution can be applied at approximately 160 degrees F. using a pressure spray, for example. The milder citric acid as a cleaning solution is preferred over hydrochloric or other acids which are more hazardous to operate with. Then the cleaned metal surfaces are washed down with a 3 percent triethanolamine solution, for example, to neutralize and wash out any remaining citric acid solution. A passivating rinse solution is then applied to the steel surfaces and dried, preferably at a temperature range of 20 to 70 degrees C. The cleaned steel surfaces are then ready to be preserved with a protective coating.

The method of this invention adds to the aqueous rinse solution a volatile water-soluble amine that boils at a higher temperature than water. While drying, as the rinse solution evaporates, the water evaporates faster than the amine leaving a thin layer of moist amine. This thin layer of moist amine finally evaporates also, leaving behind essentially clean steel.

If a very small residue of the amine remains on the surface of the steel, it will affect subsequent non-aqueous protective coating adhesion much less than would a residue of salts and/or non-volatile water soluble materials from the treatment process. A small residue of amine will dissolve into a solvent-based coating like a plasticizer and will tend to evaporate eventually. And if the non-aqueous protective coating to be applied is an epoxy coating or a urethane coating, any small residue of an amine with active hydrogens, such as a secondary amine like diethanolamine or a primary amine like ethanolamine will react with the epoxide groups or isocyanate groups in the coating and will be chemically incorporated into the coating.

Various water-soluble amines can be used for the passivation of the steel surfaces. One such amine is triethanolamine, which boils at about 277 degrees C. at a pressure of 150 mm of mercury. Other amines are diethanolamine (boiling point 217 degrees C.), ethanolamine (boiling point 170 degrees C.), and morpholine (boling point 129 degrees C.). When derusting steel with a citric acid and triethanolamine mixture, as aforementioned, triethanolamine is particularly convenient to use for passivation since it is already available for use in the process.

In experimental tests, a 1 percent aqueous solution of triethanolamine provided passivation of steel surfaces that was better than that provided by an alkaline mixture of 1 percent triethanolamine and citric acid or by an alkaline mixture of sodium nitrite, citric acid, and triethanolamine. Aqueous alkaline sodium nitrite (0.5 percent) solutions performed as well as the 1 percent triethanolamine aqueous solutions in laboratory experiments, but this material is more difficult to handle in the field since toxic fumes of oxides of nitrogen are given off if acidified, and in one field experiment it was ineffective and resulted in extensive flash rusting.

The triethanolamine passivation solution has performed well when used with the system disclosed in the aforementioned copending U.S. patent application Ser. No. 546,253. Although the method of this invention has worked well with the system of the copending U.S. patent application, it is in no way limited to use with that processing system. The copending system is designed to handle a variety of chemical solutions, including other passivation solutions. The method of applying the amine passivation solutions described in this invention is not critical to its use or effectiveness. It can be sprayed on a steel surface or the steel can be immersed in the solution, for example. The aqueous non-toxic passivating solutions used in this invention contain only volatile water-soluble amines and do not include salts or other compounds that will leave non-volatile and undesirable residue on the steel surface following drying.

When using a very dilute aqueous triethanolamine passivation solution (of about 1 percent) following the cleaning of the steel with an acidic citric acid/triethanolamine solution, it is desirable to remove as much of the cleaning solution as possible. Probably the surface first should be rinsed with a more concentrated triethanolamine solution (of about 3 percent), and then with a dilute solution rinse (of about 1 percent). In this manner, the residual citric acid is reduced to a minimum and the cleaned steel surface is assured to already be alkaline when the very dilute triethanolamine rinse solution is applied.

A purpose of this invention is to have a minimal amount of residues on the steel after passivation. It is not always possible to eliminate all residues, especially when a series of solutions are used in sequence in a cleaning operation and when complete removal of each solution is not always practical. It is, however, necessary to have the minimum possible amounts of nonvolatile impurities in the passivation solution used with this invention. The leaving of residual solutions on steel from prior operations (such as from citric acid cleaning), or the addition of small amounts of nonvolatile material (such as citric acid) in the rinse solution will not defeat the operation of this invention. The use of triethanolamine with substantial amounts of citric acid to reduce the alkalinity of the solution, however, will not give a clean steel with minimal residues. On the other hand, the addition of other volatile constituents that do not materially affect the alkalinity of the aqueous solution (such as ethyl alcohol) will not defeat the operation of this invention. Ethyl alcohol may be added to rinse solutions to speed up the subsequent drying process.

As explained above, the chief advantage of this passivation process is that there is none or very little residue left on the cleaned steel after drying, and that any such minimal residues that might remain will, therefore, not affect the adhesion or performance of subsequently applied non-aqueous protective coatings since they are incorporated into the coatings.

The aqueous amine solution is easily prepared and handled. When the proper amine is chosen (for example, triethanolamine) the passivation solution will be nontoxic and no toxic products will be formed. By contrast, however, if a sodium nitrite passivation solution is used and acidified by mixing with an acid solution, volatile toxic oxides of nitrogen will be formed which are hazardous to work crews. Also, alternative passivation solutions can leave residues on the surface of the steel, and these residues frequently promote subsequent rusting and/or impair the performance of the applied protective coatings.

The present method essentially leaves the cleaned steel surfaces clean, dry, and free of salts and nonvolatile and undesirable residues, and any minimal resue of an amine remaining on the cleaned steel surfaces is incorporated by chemical reaction into the epoxy or urethane protective coatings or dissolved into solvent-based coatings like a placticizer which is eventually evaporated.

Obviously, many modifications and variations of the present invention are possible in light of the above teachings. It is therefore to be understood that within the scope of the appended claims the invention may be practiced otherwise than as specifically described.

What is claimed is:

1. A method for the treatment and passivation of steel surfaces exposed to the atmosphere to prevent flash rusting during the cleaning and subsequent coating thereof with a non-aqueous protective coating containing amine reactive chemical groups, comprising the steps of:

a. initially preparing the steel surfaces to be treated by cleaning and removing grease, paint scale, rust and the like down to bare metal;

b. washing the prepared bare metal surfaces with a concentrated non-toxic and neutralizing aqueous first rinse solution containing only volatile water-soluble amine to rinse out and neutralize any cleaning ingredients remaining on the steel surfaces from the initial preparation thereof; said first rinse solution containing essentially no other ingredients that will leave residues on the steel surfaces detrimental to optimum performance and adhesion of subsequently applied non-aqueous protective coatings containing amine reactive chemical groups; said water-soluble amine in solution having a boiling point higher than that of water;

c. applying to the steel surfaces a dilute non-toxic aqueous passivating second rinse solution containing only a volatile water-soluble amine having a boiling point higher than that of water to the steel surfaces to ensure that the steel surfaces are essentially free of residue and that any moisture remaining on the steel surface is in a slightly alkaline condition to prevent flash rusting; said second rinse solution containing essentially no other ingredients that will leave residues on the steel surfaces detrimental to optimum performance and adhesion of subsequently applied non-aqueous protective coatings containing amine reactive chemical groups;

d. drying said steel surfaces to first evaporate and remove all water leaving a thin layer of only moist amine and then continuing the drying process to evaporate essentially all of the volatile water-soluble amine to leave the surfaces clean, thoroughly dry, free of non-volatile and undesirable residues, and ready for application of suitable non-aqueous protective coatings containing amine reactive chemical groups; said steel surfaces remaining slightly alkaline until all moisture and amine have been removed; any minimal residue of an amine remaining on the cleaned steel surfaces after drying being incorporated into the subsequently applied non-aqueous protective coatings by reaction with amine reactive chemical groups contained in said subsequently applied protective coatings without leaving any water-soluble or ionic residues on the surface of the steel so as not to affect the adhesion and performance of the protective coatings.

2. A method as in claim 1 wherein said neutralizing aqueous first and second rinse solutions are applied hot.

3. A method as in claim 1 wherein the water-soluble amine in said first and second rinse solutions is triethanolamine.

4. A method as in claim 1 wherein the water-soluble amine in said first and second rinse solutions is diethanolamine having a boiling point of about 217 degrees C.

5. A method as in claim 1 wherein the water-soluble amine in said first and second rinse solutions is ethanolamine having a boiling point of about 170 degrees C.

6. A method as in claim 1 wherein the water-soluble amine in said first and second rinse solutions is morpholine having a boiling point of about 129 degrees C.

7. A method as in claim 1 wherein any minimal residue of amine remaining on the cleaned steel surfaces reacts with isocyanate groups in a urethane type coating subsequently applied thereto.

8. A method as in claim 1 wherein any minimal residue of amine remaining on the cleaned steel surfaces reacts with epoxide groups in an epoxy type protective coating subsequently applied thereto.

9. A method as in claim 1 wherein said concentrated neutralizing first rinse solution is an approximately 3 percent amine aqueous solution.

10. A method as in claim 1 wherein said dilute passivating second rinse solution is an approximately 1 percent amine aqueous solution.

11. A method as in claim 1 wherein a chemical cleaning solution comprising a 5 to 10 percent citric acid solution adjusted to a pH of about 3.5 is used in initially preparing and cleaning the steel surfaces down to bare metal.

12. A method as in claim 11 wherein triethanolamine is used to adjust the pH of the citric acid solution to about 3.5.

13. A method as in claim 11 wherein ammonia is used to adjust the pH of the citric acid solution to about 3.5.

14. A method as in claim 11 wherein the citric acid solution is applied at approximately 160 degrees F.

15. A method as in claim 11 wherein said neutralizing solution is applied to the bare metal surfaces by spraying under pressure.

16. A method as in claim 1 wherein ethyl alcohol is added to the second rinse solution to speed up the subsequent drying process.

17. A method for the treatment and passivation of steel surfaces exposed to the atmosphere to prevent flash rusting during the cleaning and subsequent coating thereof with a non-aqueous solvent-based protective coating, comprising the steps of:

a. initially preparing the steel surfaces to be treated by cleaning and removing grease, paint scale, rust and the like down to bare metal;

b. washing the prepared bare metal surfaces with a concentrated non-toxic and neutralizing aqueous first rinse solution containing only volatile water-soluble amine to rinse out and neutralize any cleaning ingredients remaining on the steel surfaces from the initial preparation thereof; said water-soluble amine in solution having a boiling point higher than that of water; said first rinse solution containing essentially no other ingredients that may leave residues on the steel surfaces detrimental to optimum performance and adhesion of subsequently applied non-aqueous solvent-based protective coatings;

c. applying a dilute non-toxic aqueous passivating second rinse solution containing only a volatile water-soluble amine having a boiling point higher than that of water to the steel surfaces to ensure that the steel surfaces are essentially free of residue and that any moisture remaining on the steel surfaces is in a slightly alkaline condition to prevent flash rusting; said second rinse solution containing essentially no other ingredients that may leave residues on the steel surfaces detrimentral to optimum performance and adhesion of subsequently applied non-aqueous solvent-based protective coatings;

d. drying said steel surfaces to first evaporate and remove all water leaving a thin layer of only moist amine and then continuing the dry process to evaporate essentially all of the volatile water-soluble amine to leave the surfaces clean, dry, free of non-volatile and undesirable residues, and ready for application of the non-aqueous solvent-based protective coatings; said steel surfaces remaining slightly alkaline until all moisture and amine have been removed; any minimal residue of an amine remaining on the cleaned steel surfaces after drying beng incorporated into the subsequently applied non-aqueous solvent-based protective coating without leaving any water-soluble or ionic residues on the surface of the steel so as not to affect the adhesion and performance of the protective coatings by being dissolved therein as a plasticizer which is later evaporated.

18. A method as in claim 17 wherein the water-soluble amine in said neutralizing first rinse solution and in said passivating second rinse solution is triethanolamine.

19. A method as in claim 17 wherein said neutralizing aqueous first rinse solution is applied hot.

20. A method as in claim 17 wherein said passivating second rinse solution is applied hot.

21. A method as in claim 17 wherein said concentrated neutralizing first rinse solution is an approximately 3 percent amine aqueous solution.

22. A method as in claim 17 wherein said dilute passivating second rinse solution is an approximately 1 percent amine aqueous solution.

23. A method as in claim 17 wherein a chemical cleaning solution comprising a 5 to 10 percent citric acid solution adjusted to a pH of about 3.5 is used in initially preparing and cleaning the steel surfaces down to bare metal.

24. A method as in claim 23 wherein triethanolamine is used to adjust the pH of the citric acid solution to about 3.5.

25. A method as in claim 23 wherein ammonia is used to adjust the pH of the citric acid solution to about 3.5.

26. A method as in claim 23 wherein the chemical cleaning solution is applied at approximately 160 degrees F.

27. A method as in claim 23 wherein said neutralizing solution is applied to the bare metal surfaces by spraying under pressure.

28. A method as in claim 23 wherein ethyl alcohol is added to the second rinse solution to speed up the subsequent drying process.

29. A method for the treatment and passivation of steel surfaces exposed to the atmosphere to prevent flash rusting during the cleaning and subsequent coating thereof with a protective non-aqueous solvent-based coating, comprising the steps of:

a. initially preparing the steel surfaces to be treated by cleaning and removing grease, paint, scale, rust and the like down to bare metal with a cleaning solution comprising a 5 to 10 percent citric acid solution adjusted to a pH of about 3.5 applied at approximately 160 degrees F.;

b. washing the prepared bare metal surfaces with a first rinse of non-toxic neutralizing aqueous solution of approximately 3 percent volatile water-soluble triethanolamine to rinse out and neutralize any cleaning ingredients remaining on the steel surfaces from the initial preparation thereof; said triethanolamine in solution having a boiling point higher than that of water; said first rinse solution containing essentially no other ingredients that may leave residue on the steel surfaces detrimental to optimum adhesion and performance of the subsequently applied non-aqueous solvent-based protective coating;

c. applying a non-toxic aqueous passivating second rinse solution of approxiately 1 percent volatile water-soluble triethanolamine at a temperature range of approximately 20 to 70 degrees C. to the steel surfaces to ensure that the steel surfaces are essentially free of residue and that any moisture remaining on the steel surfaces is in a slightly alkaline condition to prevent rusting; said second rinse solution containing essentially no other ingredients that may leave residues on the steel surfaces detrimental to optimum adherance and performance of the subsequently applied non-aqueous solvent-based protective coating;

d. drying said steel surfaces to first evaporate and remove all water leaving only a thin layer of moist amine; continuing the drying process to evaporate essentially all of the volatile water-soluble amine to leave the surfaces clean, dry, free of non-volatile and undesirable residue and ready for application of non-aqueous solvent-based protective coatings; said steel surfaces remaining slightly alkaline until all moisture and amine have been removed and any minimal residue of triethanolamine remaining on the dry, cleaned steel surfaces being dissolved and incorporated into the subsequently applied non-aqueous solvent-based protective coating and not affecting the adhesion and preformance of the protective coating.

30. A method for the treatment and passivation of steel surfaces exposed to the atmosphere to prevent flash rusting during the cleaning and subsequent coating thereof with a non-aqueous protective coating, comprising the steps of:

a. initially preparing the steel surfaces to be treated by cleaning and removing grease, paint scale, rust and the like down to bare metal;

b. treating the prepared bare metal surfaces with a concentrated non-toxic and neutralizing aqueous first rinse solution containing only volatile water-soluble amine, said water-soluble amine in solution having a boiling point higher than that of water to rinse out and neutralize any acid and other cleaning ingredients remaining on the steel surfaces from the initial preparation thereof; said first rinse solution containing essentially no other ingredients that may leave residues on the steel surfaces detrimental to the optimum adherance and performance of the subsequently applied non-aqueous protective coating;

c. subsequently treating the steel surfaces with a dilue non-toxic aqueous passivating second rinse solution containing only a volatile water-soluble amine, having a boiling point higher than that of water, to ensure that the steel surfaces are essentially free of residue and that any moisture remaining on the steel surfaces is in a slightly alkaline condition to prevent flash rusting; said second rinse solution containing essentially no other ingredients that may leave residues on the steel surfaces detrimental to the adherance and performance of the subsequently applied non-aqueous protective coating;

d. drying said steel surfaces to first evaporate and remove all water leaving a thin layer of only moist amine and then continuing the drying process to evaporate essentially all of the volatile water-soluble amine to leave the surfaces clean, thoroughly dry, free of non-volatile and undesirable residues, and ready for subsequent application of suitable non-aqueous protective coatings; said steel surfaces remaining slightly alkaline until all moisture and amine have been removed;

e. subsequently applying a suitable non-aqueous protective coating to said prepared steel surfaces; any minimal residue of an amine remaining on the cleaned steel surfaces after drying being incorporated into the subsequently applied non-aqueous protective coatings without leaving any water-soluble or ionic residues on the surfaces of the steel so as not to affect the adhesion and performance of the protective coatings.

* * * * *